US008781143B2

(12) United States Patent
Pedersen et al.

(10) Patent No.: US 8,781,143 B2
(45) Date of Patent: Jul. 15, 2014

(54) HEARING AID WITH IMPROVED MAGNETIC RECEPTION DURING WIRELESS COMMUNICATION

(75) Inventors: Brian Dam Pedersen, Ringsted (DK); Gerard Nijsse, 'S-Gravenhage (NL)

(73) Assignee: GN Resound A/S, Ballerup (DK)

( * ) Notice: Subject to any disclaimer, the term of this patent is extended or adjusted under 35 U.S.C. 154(b) by 83 days.

(21) Appl. No.: 13/330,524

(22) Filed: Dec. 19, 2011

(65) Prior Publication Data

US 2013/0156239 A1 Jun. 20, 2013

(30) Foreign Application Priority Data

Dec. 16, 2011 (DK) ..... 2011 70720
Dec. 16, 2011 (EP) ..... 11194017

(51) Int. Cl.
*H04R 25/00* (2006.01)

(52) U.S. Cl.
USPC ..... 381/315; 381/312

(58) Field of Classification Search
USPC ..... 381/312, 314–318, 320–321
See application file for complete search history.

(56) References Cited

U.S. PATENT DOCUMENTS 7,283,639 B2 * 10/2007 Kariniemi ..... 381/312
7,447,325 B2 * 11/2008 Bren et al. ..... 381/312
2004/0052391 A1 3/2004 Bren et al.
2005/0201577 A1 9/2005 Kariniemi
2007/0274550 A1 11/2007 Baechler et al.

OTHER PUBLICATIONS

Extended European Search Report dated Jul. 2, 2012 for EP Patent Application No. 11194017.7.
First Office Action dated May 16, 2012, for Danish Patent Application No. PA 2011 70720.
Second Technical Examination dated Dec. 12, 2012 for DK Patent Application No. PA 2011 70720.

* cited by examiner

*Primary Examiner* — Suhan Ni
(74) *Attorney, Agent, or Firm* — Vista IP Law Group, LLP

(57) ABSTRACT

A hearing aid includes a magnetically sensitive transducer for conversion of a varying magnetic field into an audio signal, a processor configured to generate a hearing loss compensated output signal based on the audio signal, an output transducer for providing an auditory output signal based on the hearing loss compensated output signal, an RF transceiver for wireless communication, and a communication controller that is configured to turn the RF transceiver on and off, wherein the processor is further configured to generate the hearing loss compensated output signal based on an estimate of the audio signal within a time period comprising an event that the RF transceiver changes state between on and off, and wherein the estimate is based at least on a part of the audio signal input to the processor outside the time period.

16 Claims, 3 Drawing Sheets

HEARING AID WITH IMPROVED MAGNETIC RECEPTION DURING WIRELESS COMMUNICATION

RELATED APPLICATION DATA

Figure 1:
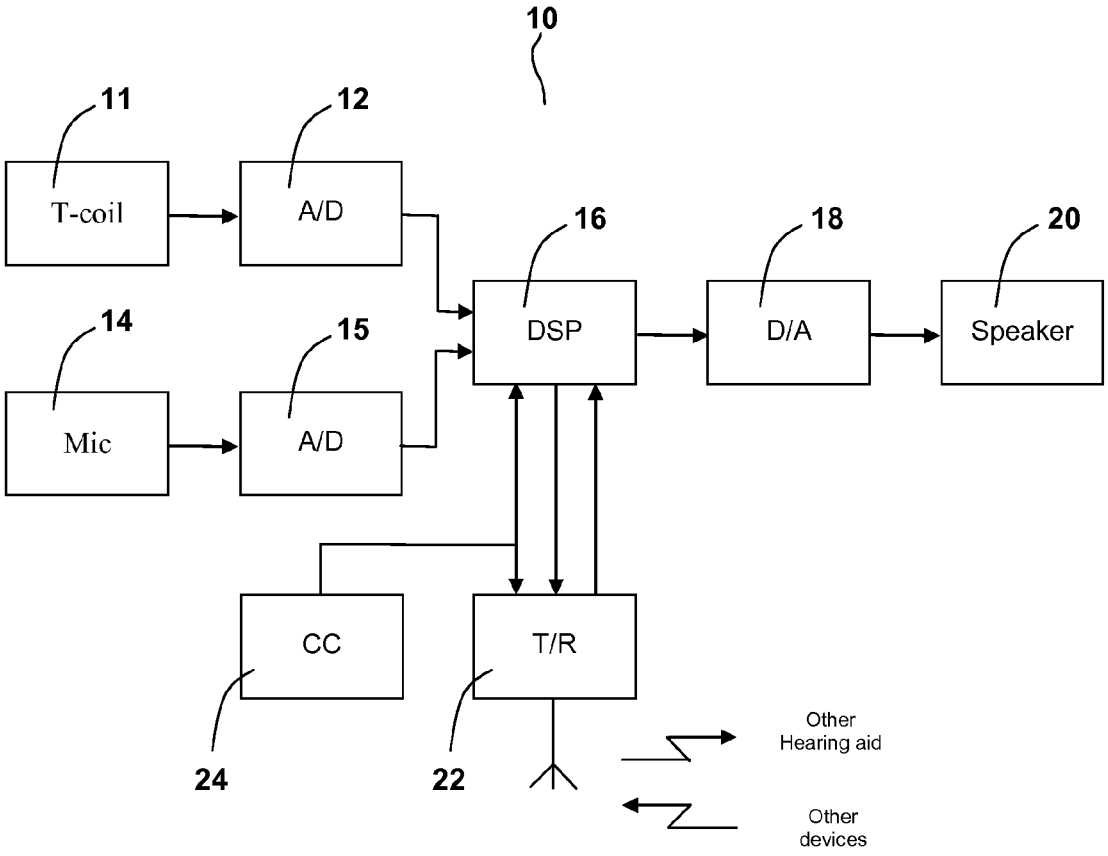

This application claims priority to and the benefit of Danish Patent Application No. PA 2011 70720, filed on Dec. 16, 2011, pending, and EP Application No. EP 11194017, filed on Dec. 16, 2011, pending, the entire disclosure of which is expressly incorporated by reference herein.

FIELD AND BACKGROUND

The present application relates to a hearing aid with a telecoil, or another magnetically sensitive transducer, and an RF transceiver for wireless communication, e.g. via a wireless network, such as for wireless interconnection of two hearing aids in a binaural hearing aid system, and wireless interconnection of hearing aids with other devices, such as a remote control for a hearing aid, a fitting instrument, a mobile phone, a headset, a door bell, an alarm system, a broadcast system, etc, etc.

SUMMARY

Magnetic pick-up coils, often referred to as telecoils or T-coils (from "Telephone Coils"), in hearing aids allow audio sources to be electro-magnetically, i.e. non-acoustically, connected to a hearing aid, which is intended to help the wearer filter out background noise. They can be used with telephones, FM systems (with neck loops), and induction loop systems, also called "hearing loops", that transmit sound to hearing aids from public address systems and TVs. Hearing loops are widely used in churches, shops, railway stations, and other public places.

A telecoil consists of a metal core (or rod) around which ultra-fine wire is coiled. Telecoils generate an electrical signal in response to a varying magnetic field.

Although a telecoil constitutes a wide-band receiver, interference is unusual in most hearing loop situations. Interference can manifest as a buzzing sound, which varies in volume depending on the distance between the wearer and the source. Sources are electromagnetic fields, such as CRT computer monitors, older fluorescent lighting, some dimmer switches, many household electrical appliances and airplanes.

In addition, an RF-transceiver of the hearing aid may also generate interference. During normal operation, power consumption of hearing aid circuitry is very low. In an example, a hearing aid has a current consumption of 1 mA during normal operation.

Typically, an RF transceiver in a hearing aid consumes a comparatively large amount of power during transmission or reception. For example, the current consumption of the RF transceiver circuitry may increase from 50 μA to 30 mA during transmission or reception by the RF transceiver. Therefore, turning the RF transceiver on or off generates a large current transient in the hearing aid circuitry, and during the duration of the current transient, a varying magnetic field with large magnetic field gradients is generated.

The magnetic field gradients are picked up by the telecoil and induce a disturbing signal in the electronic telecoil signal output by the telecoil, e.g. residing in a hearing loop. The disturbing signal interferes with the desired signal in a disturbing and bothering way for the wearer of the hearing aid.

The characteristics of the current transients generated in the hearing aid changes over time, e.g. as a function of the degree of depletion of the hearing aid battery, the number of previous charging cycles having been applied to the battery, the type of battery currently in use, etc.

Conventionally, this interference problem has been solved by turning the RF transceiver off whenever the telecoil is selected as an input source for inputting the electronic telecoil signal to the processor of the hearing aid, for example when the user desires to listen to signals of a hearing loop. However, this way of solving the problem prevents the user of the hearing aid from using a remote control to adjust the hearing aid and also prevents transmission of signals to the other hearing aid in a binaural hearing aid system.

Thus, there is a need for a hearing aid that allows use of the telecoil, or another magnetically sensitive transducer, as an input source of the hearing aid and simultaneous RF-transmission without the RF-transmission causing interference in the signal output by the hearing aid in response to the output signal of the telecoil or another magnetically sensitive transducer.

In the new hearing aid, interference from the RF-transceiver of the hearing aid is prevented by substitution of the output signal of the magnetically sensitive transducer disturbed by current transients generated when the RF-transceiver is turned on or off with an estimated output signal, wherein the estimate is based on parts of the output signal that have not been disturbed by turning the RF-transceiver on or off.

Thus, a new method of removing interference from a hearing aid audio signal is provided, comprising the steps of:

converting a varying magnetic field into an audio signal, generating a hearing loss compensated output signal based on the audio signal, converting the hearing loss compensated output signal to an auditory output signal that can be received by the human auditory system, controlling turn-on and turn-off of an RF transceiver of the hearing aid, forming an estimate of the audio signal that is within a time period comprising an event that the RF transceiver changes state between on and off, wherein the estimate is formed based on the audio signal obtained outside the time period, and generating the hearing loss compensated output signal based on the estimate of the audio signal that is within the time period.

The method may further comprise at least one of the following steps:

(a) forming an estimate of the audio signal before the time period, the estimate of the audio signal before the time period being based on a part of the audio signal input to the processor after the time period, and wherein the hearing loss compensated output signal is also based on the estimate of the audio signal before the time period, and (b) forming an estimate of the audio signal after the time period, the estimate of the audio signal after the time period being based on a part of the audio signal input to the processor before the time period, and wherein the hearing loss compensated output signal is also based on the estimate of the audio signal after the time period.

Further, a new hearing aid is provided, comprising a magnetically sensitive transducer for conversion of a varying magnetic field into an audio signal, a processor configured to generate a hearing loss compensated output signal based on the audio signal, an output transducer for conversion of the hearing loss compensated output signal to an auditory output signal that can be received by the human auditory system, e.g. an acoustic output signal, an RF transceiver for wireless communication, and a communication controller that is configured to turn the RF transceiver on and off, and wherein, the processor is further configured to generate the hearing loss compensated output signal based on an estimate of the audio signal within a time period comprising an event that the RF transceiver changes state between on and off, and wherein the estimate is based on a part of the audio signal input to the processor outside the time period.

The processor may also be configured to generate the hearing loss compensated output signal based on an estimate of the audio signal before the time period, the estimate of the audio signal before the time period being based on the audio signal that is input to the processor after the time period.

The processor may also be configured to generate the hearing loss compensated output signal based on an estimate of the audio signal after the time period, the estimate of the audio signal after the time period being based on the audio signal that is input to the processor before the time period.

When the communication controller turns the RF transceiver on or off, the processor receives information that the RF transceiver is turned on or off so that the processor can substitute the audio signal with an estimated signal within an appropriate time interval.

Typically, the auditory output signal is an acoustic signal that is transmitted towards the ear drum of the wearer of the hearing aid; however, the auditory output signal may also be an electronic signal for electronic stimulation of the auditory system of the user, for example using a cochlear implant.

Throughout the present disclosure, the term "audio signal" may be used to identify any analogue or digital signal forming part of the signal path from the output of the magnetically sensitive transducer to an input of the signal processor.

The magnetically sensitive transducer may be any transducer capable of converting a varying magnetic field into an audio signal, such as a telecoil, GMR sensor (Giant MagnetoResistance sensor), Hall sensor, etc.

The hearing aid may also include an input transducer, preferably a microphone, or an array of microphones, for conversion of an acoustic sound signal into an electronic transducer signal.

In a digital hearing aid, the electronic transducer signal and the audio signal are digitized by respective AD-converters.

The signal processor, such as a digital signal processor or DSP, may be configured to process a selected one of, or a selected combination of, the audio signal and the electronic transducer signal in accordance with a selected signal processing algorithm into a processed output signal for compensation of hearing loss, for example including a compressor for compensation of dynamic range hearing loss.

The time period includes the time during which the current transient disturbs or distorts the audio signal, and typically, the time period starts at turn-on or turn-off of the RF-transceiver. Within the time period, the audio signal is substituted by an estimated signal calculated from the audio signal outside the time period, e.g. preceding the time period, or succeeding the time period, or a combination. In a digital hearing aid, the samples of the audio signal are substituted by estimated samples calculated from samples of the audio signal outside the time period, such as samples preceding the time period, or samples succeeding the time period, or a combination of samples preceding and samples succeeding the time period.

Thus, the estimate may be based on extrapolation of the audio signal input to the processor outside the time period, e.g. the estimate may be based on extrapolation of the audio signal input to the processor before the time period, i.e. forward prediction; or, the estimate may be based on extrapolation of the audio signal input to the processor after the time period, i.e. backward prediction; or, the estimate may be based on a combination of extrapolation of the audio signal input to the processor before and after the time period, respectively, i.e. both forward and backward prediction.

Obviously, backward prediction requires delaying the signal, parts of which are to be estimated, in order for the signal after the time period to be available for estimation of the signal within the time period.

Samples in the time period may be estimated using Linear Predictive Coding based on samples preceding the time period, or samples succeeding the time period, or a combination of samples preceding and samples succeeding the time period.

The estimates may be weighted with a window, such as a Hanning window. Windowing minimizes formation of artefacts in the auditory output signal of the hearing aid by transition from the audio signal itself to an estimate of the audio signal.

Other estimates may be calculated using other formulas, such as Warped Linear Predictive Coding, Polynomial extrapolation, etc.

The estimate may also be calculated in the frequency domain, for example based on calculation of the Fast Fourier Transform of the audio signal input to the processor before the time period, i.e. forward prediction in the frequency domain; or, the estimate may be based on calculation of the Fast Fourier Transform of the audio signal input to the processor after the time period, i.e. backward prediction in the frequency domain; or, the estimate may be based on a combination of calculation of the Fast Fourier Transform of the audio signal input to the processor before and after the time period, respectively, i.e. both forward and backward prediction in the frequency domain.

In order to further smooth the transition from real samples of the audio signal to estimated samples, one or more consecutive samples immediately preceding the time period, or one or more consecutive samples immediately succeeding the time period, or both, may also be substituted with estimated samples, wherein the original undisturbed signal samples are included in the estimates.

For example, the most recent undisturbed signal sample occurring immediately before turn-on or turn-off of the RF transceiver may be substituted by an estimate calculated from samples occurring after the time period in a weighted combination with the undisturbed audio signal sample itself in order to gradually change from the undisturbed audio signal itself to an estimate of the audio signal.

Likewise, the first undisturbed signal sample occurring after turn-on or turn-off of the RF transceiver may be substituted by an estimate calculated from samples occurring before the time period in a weighted combination with the undisturbed signal sample itself in order to gradually change from an estimate of the audio signal to the undisturbed audio signal itself.

The hearing aid including the processor may further be configured to process the signal in a plurality of frequency channels.

An estimate of the audio signal may be provided in at least one frequency channel of the plurality of frequency channels, such as in one or more selected frequency channels, such as in all of the frequency channels.

The plurality of frequency channels may include warped frequency channels, for example all of the frequency channels may be warped frequency channels.

In accordance with some embodiments, a hearing aid includes a magnetically sensitive transducer for conversion of a varying magnetic field into an audio signal, a processor configured to generate a hearing loss compensated output signal based on the audio signal, an output transducer for providing an auditory output signal based on the hearing loss compensated output signal, an RF transceiver for wireless communication, and a communication controller that is configured to turn the RF transceiver on and off, wherein the processor is further configured to generate the hearing loss compensated output signal based on an estimate of the audio signal within a time period comprising an event that the RF transceiver changes state between on and off, and wherein the estimate is based at least on a part of the audio signal input to the processor outside the time period.

In one or more embodiments, the estimate may be based on extrapolation of the part of the audio signal input to the processor outside the time period.

In one or more embodiments, the part of the audio signal may be input to the processor before the time period.

In one or more embodiments, the part of the audio signal may be input to the processor after the time period.

In one or more embodiments, the part of the audio signal on which the estimate is based may have a duration that is at least twice as long as the time period.

In one or more embodiments, the estimate may be formed using Linear Predictive Coding.

In one or more embodiments, the estimate may be formed using Warped Linear Predictive Coding.

In one or more embodiments, the estimate may be formed using windowing.

In one or more embodiments, the windowing may comprise a Hanning window.

In one or more embodiments, the processor may also be configured to generate the hearing loss compensated output signal based on an estimate of the audio signal before the time period, the estimate of the audio signal before the time period being based on a part of the audio signal that is input to the processor after the time period.

In one or more embodiments, the processor may also be configured to generate the hearing loss compensated output signal based on an estimate of the audio signal after the time period, the estimate of the audio signal after the time period being based on a part of the audio signal that is input to the processor before the time period.

In one or more embodiments, the processor may further be configured to process the audio signal in a plurality of frequency channels, and wherein the estimate of the audio signal may be provided in at least one of the plurality of frequency channels.

In accordance with other embodiments, a method of removing interference from a hearing aid audio signal includes converting a varying magnetic field into an audio signal, generating a hearing loss compensated output signal based on the audio signal, providing an auditory output signal based on the hearing loss compensated output signal, controlling turn-on and turn-off of an RF transceiver of the hearing aid, forming an estimate of the audio signal that is within a time period comprising an event that the RF transceiver changes state between on and off, wherein the estimate is formed based at least on the audio signal obtained outside the time period, and generating the hearing loss compensated output signal based on the estimate of the audio signal that is within the time period.

In one or more embodiments, the estimate may be formed utilizing Linear Prediction Coding.

In one or more embodiments, the hearing loss compensated output signal may also be based on an estimate of the audio signal before the time period, the estimate of the audio signal before the time period being based on a part of the audio signal input to the processor after the time period.

In one or more embodiments, the hearing loss compensated output signal may also be based on an estimate of the audio signal after the time period, the estimate of the audio signal after the time period being based on a part of the audio signal input to the processor before the time period.

Other and further aspects and features will be evident from reading the following detailed description of the embodiments.

DESCRIPTION OF THE DRAWING FIGURES

Figure 2:
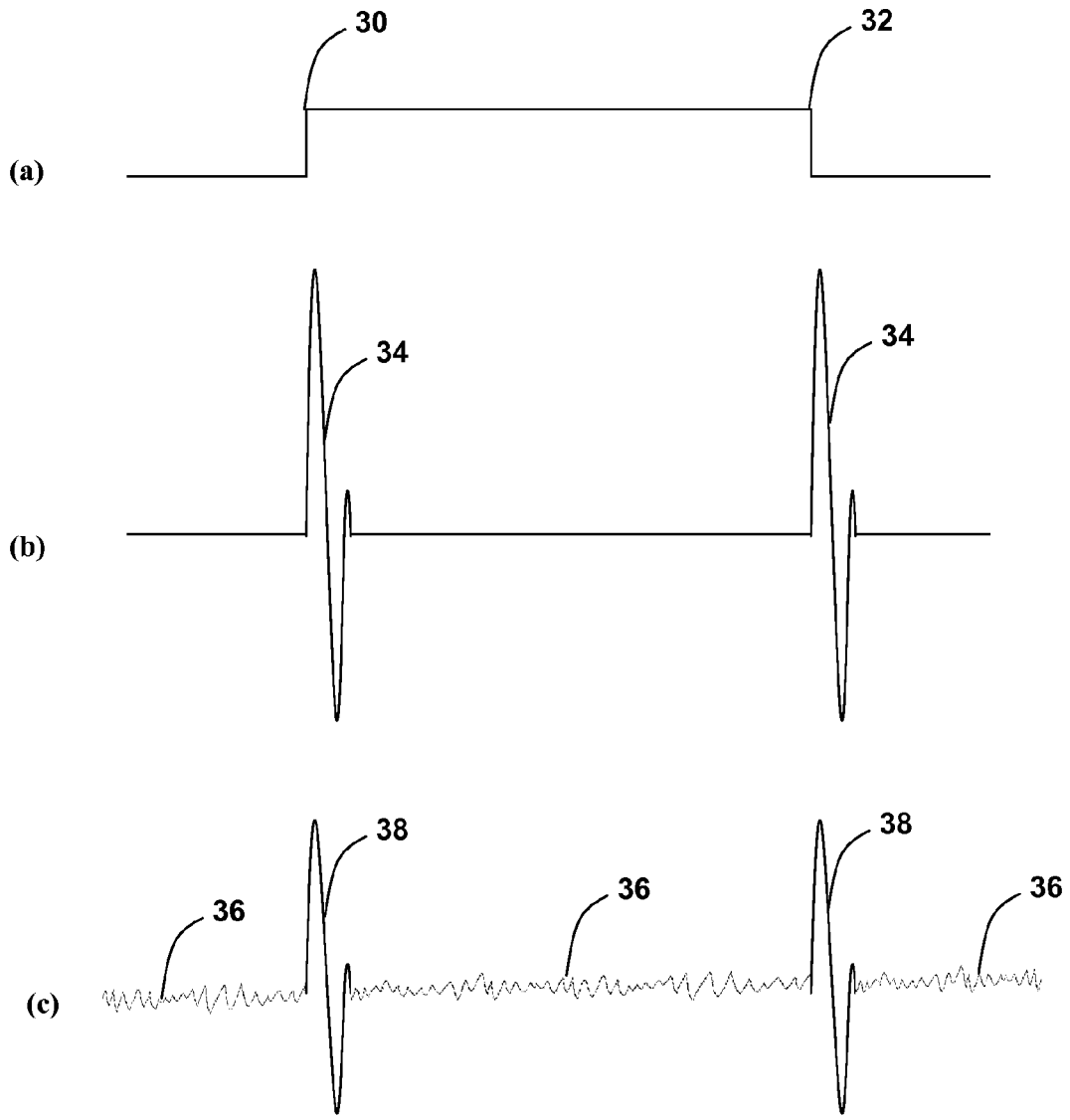
Figure 3:
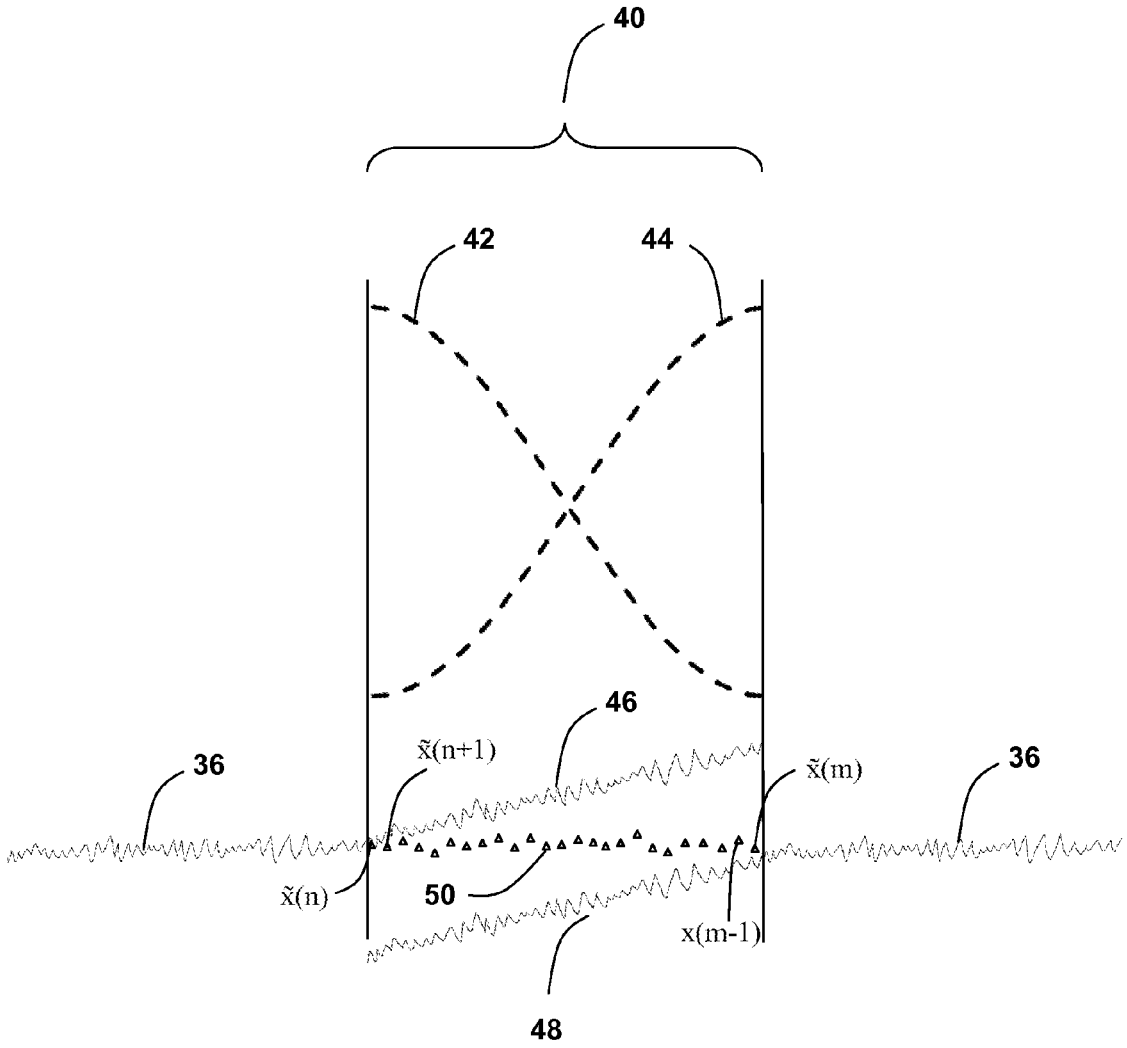

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in the scope of the claims. The embodiments will be described in more detail with reference to the drawings, wherein FIG. 1 shows a block diagram of a hearing aid with a telecoil and an RF-transceiver, FIG. 2 shows a plot of signals in the hearing aid of FIG. 1, and FIG. 3 illustrates audio signal estimation.

DETAIL DESCRIPTION

Various embodiments are described hereinafter with reference to the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. The new hearing aid will now be described more fully hereinafter with reference to the accompanying drawings, in which various examples are shown. The appended patent claims may be embodied in different forms not shown in the accompanying drawings and should not be construed as limited to the examples set forth herein.

FIG. 1 is a simplified block diagram of an exemplary new hearing aid 10.

The hearing aid 10 comprises a telecoil 11 for conversion of a varying magnetic field, as for example generated in a hearing loop, into an electronic telecoil signal, an analogue-to-digital (A/D) converter 12 for provision of a digitized electronic telecoil signal, an input transducer 14, preferably a microphone, or an array of microphones, an analogue-to-digital (A/D) converter 15 for provision of a digitized electronic transducer signal in response to sound signals received at the transducer 14, a signal processor 16 (e.g. a digital signal processor or DSP) that is configured to process a selected one of, or a selected combination of, the digitized electronic telecoil signal and the digitized electronic transducer signal in accordance with a selected signal processing algorithm into a processed output signal for compensation of hearing loss, for example including a compressor for compensation of dynamic range hearing loss, a digital-to-analogue (D/A) converter 18, and an output transducer 20 for conversion of the processed digital output signal into an auditory output signal, e.g. a receiver outputting an acoustic signal for transmission towards the eardrum of the wearer of the hearing aid.

Further, the hearing aid 10 has an RF transceiver 22 for wireless communication, e.g. via a wireless network, such as for wireless interconnection of two hearing aids in a binaural hearing aid system, and wireless interconnection of hearing aids with other devices, such as a remote control for a hearing aid, a fitting instrument, a mobile phone, a headset, a door bell, an alarm system, a broadcast system, etc, etc, and a communication controller 24 that is configured to turn the RF transceiver on and off in order to save power between data communication.

FIG. 2 schematically illustrates how the electronic telecoil signal 36 is disturbed or distorted by large current transients 34 caused by turn-on or turn-off of the RF-transceiver 22 supplied by the power source of the hearing aid.

The uppermost curve (a) in FIG. 2 indicates turn-on 30 and turn-off 32 of the RF-transceiver of the hearing aid. Curve (b) shows the current transients 34, i.e. dI/dt, in the power lines supplying the RF-transceiver 22, and curve (c) schematically shows the electronic telecoil signal 36 including interference 38 with the electronic telecoil signal caused by the current transients 34.

In the example illustrated in FIG. 3, the time period 40 starts at turn-on 30 or turn-off 32, respectively, of the RF-transceiver 22, and has the duration of 500 μs. After 500 μs, the current transient 34 has ceased to disturb the electronic telecoil signal 36 and the electronic telecoil signal 36 is no longer substituted by an estimate. The time between turn-on 30 and turn-off 32 of the transceiver 22 is app. 6 ms.

At a 20 kHz sample rate, a time period of 500 μs contains 25 samples. The 25 samples of the time period are discarded and substituted by estimated samples 50 indicated by triangles in FIG. 3.

Preferably, the samples 50 in the time period 40 are estimated using Linear Predictive Coding based on samples preceding the time period 40, i.e. forward prediction, and samples succeeding the time period 40, i.e. backward prediction. In order to provide a good estimate, at least twice as many samples as the samples discarded are used for forward prediction and backward prediction.

The estimates may be weighted with a window 42, 44, such as a Hanning window. Windowing minimizes formation of artefacts in the auditory output signal of the hearing aid caused by the transition from the electronic telecoil signal itself to an estimate of the electronic telecoil signal.

Thus, in the illustrated example, the combination of samples 46 extrapolated from samples before the time period 40 and samples 48 extrapolated from samples after the time period 40 may be formed by a weighted linear combination of Linear Predictive Coding of samples preceding the time period 40 and Linear Predictive Coding of samples succeeding the time period 40, for example weighted with windows, such as a Hanning windows 42, 44, in such a way that Linear Predictive Coding of samples preceding the time period 40 has the largest weight at the beginning of the time period 40 and decreases with time with minimum weight at the end of the time period 40, while Linear Predictive Coding of samples succeeding the time period 40 has the minimum weight at the beginning of the time period 40 and increases with time with the largest weight at the end of the time period 40.

For forward prediction, the following equation (1) is used:

$$\tilde{x}(n)=\Sigma_{i=1}^{p} a_i x(n-i) \tag{3}$$

where $\tilde{x}(n)$ is the predicted sample value, $x(n-i)$ are the previous sample values, and $a_i$ are the predictor coefficients. Preferably, the predictor coefficients are calculated using an autoregressive model, preferably using the Levinson-Durbin recursion. In the illustrated example, the number of estimated samples in the time period 40 is 25, and in order to provide a good estimate, p ranges from 12-16, and $a_i$ is preferably based on 64 previous sample values. The 25 estimated samples are calculated successively using equation (1). $\tilde{x}(n)$ is the first sample in the time period 40. When $\tilde{x}(n)$ has been calculated using equation (1), $\tilde{x}(n+1)$ is calculated from equation (1) incorporating the calculated value for $\tilde{x}(n)$ etc. until all forward predicted samples 46 of the time period 40 have been calculated.

In the same way, the samples of the time period 40 are estimated using backward prediction according to the following equation (2):

$$\tilde{x}(m)=\Sigma_{i=1}^{p} b_i x(m+i) \tag{2}$$

where $\tilde{x}(m)$ is the predicted sample value, $x(m+i)$ are the succeeding sample values, and $b_i$ are the predictor coefficients. Preferably, the predictor coefficients $b_i$ are calculated using an autoregressive model, preferably using the Levinson-Durbin recursion. In order to provide a good estimate, p ranges from 12-16, and $b_i$ is preferably based on 64 succeeding sample values. The 25 estimated samples are calculated successively using equation (2). $\tilde{x}(m)$ is the last sample in the time period 40. When $\tilde{x}(m)$ has been calculated from equation (2), $\tilde{x}(m-1)$ is calculated from equation (2) incorporating the calculated value for $\tilde{x}(m)$ etc. until all backward predicted samples 48 of the time period 40 have been calculated.

Finally, the resulting estimated samples 50 are calculated from a weighted sum of the respective forward predicted samples 46 and backward predicted samples 48, wherein the weights are defined by respective Hanning windows 42, 44 positioned so that the weights 42 of the forward predicted samples 46 have their maximum value at the first sample of the time period 40, and the weights 44 of the backward predicted samples 48 have their maximum value at the last sample of the time period 40.

The weights 42 wF(n) of the forward predicted samples are calculated in accordance with equation (2):

$$wF(n) = 0.5\left(1 - \cos\pi\left(1 + \frac{n}{N-1}\right)\right) \tag{2}$$

The weights 44 wB(n) of the backward predicted samples are calculated in accordance with equation (3):

$$wB(n) = 0.5\left(1 - \cos\pi\left(\frac{n}{N-1}\right)\right) \tag{3}$$

N is the number of estimated samples in the time period 40.

In order to further smooth the transition from the electronic telecoil signal 36 to the estimated signal 50, one or more undisturbed samples immediately preceding the time period 40 may also be substituted by estimated values formed by a weighted combination of the undisturbed sample values themselves and respective backward predicted estimates, and likewise, one or more undisturbed samples immediately succeeding the time period 40 may also be substituted by estimated values formed by weighted combination of the undisturbed sample values themselves and respective forward predicted estimates.

Other estimates may be calculated using other formulas, such as Warped Linear Predictive Coding, Polynomial extrapolation, etc.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a magnetically sensitive transducer for conversion of a varying magnetic field into an audio signal;

a processor configured to generate a hearing loss compensated output signal;

an output transducer for providing an auditory output signal based on the hearing loss compensated output signal;

an RF transceiver for wireless communication; and a communication controller that is configured to turn the RF transceiver on and off;

wherein the processor is configured to generate the hearing loss compensated output signal based on an estimate of a part of the audio signal that is within a time period comprising an event that the RF transceiver changes state between on and off; and wherein the estimate is based at least on a part of the audio signal outside the time period.

2. The hearing aid according to claim 1, wherein the estimate is based on extrapolation of the part of the audio signal outside the time period.

3. The hearing aid according to claim 2, wherein the part of the audio signal that is outside the period is before the time period.

4. The hearing aid according to claim 2, wherein the part of the audio signal that is outside the period is after the time period.

5. The hearing aid according to claim 1, wherein the estimate of the part of the audio signal has at least twice as many samples as the part of the audio signal that is within the time period.

6. The hearing aid according to claim 1, wherein the estimate is formed using Linear Predictive Coding.

7. The hearing aid according to claim 1, wherein the estimate is formed using Warped Linear Predictive Coding.

8. The hearing aid according to claim 1, wherein the estimate is formed using windowing.

9. The hearing aid according to claim 8, wherein the windowing comprises a Hanning window.

10. The hearing aid according to claim 1, wherein the processor is also configured to generate the hearing loss compensated output signal based on an estimate of a part of the audio signal before the time period, the estimate of the part of the audio signal before the time period being based on a part of the audio signal that is after the time period.

11. The hearing aid according to claim 1, wherein the processor is also configured to generate the hearing loss compensated output signal based on an estimate of a part of the audio signal after the time period, the estimate of part of the audio signal after the time period being based on a part of the audio signal that is before the time period.

12. The hearing aid according to claim 1, wherein the processor is further configured to process the audio signal in a plurality of frequency channels, and wherein the estimate of the part of the audio signal is provided in at least one of the plurality of frequency channels.

13. A method of removing interference from a hearing aid audio signal, comprising:

converting a varying magnetic field into an audio signal;

generating a hearing loss compensated output signal;

providing an auditory output signal based on the hearing loss compensated output signal;

controlling turn-on and turn-off of an RF transceiver of the hearing aid; and forming an estimate of a part the audio signal that is within a time period comprising an event that the RF transceiver changes state between on and off, wherein the estimate is formed based at least on a part of the audio signal obtained outside the time period;

wherein the hearing loss compensated output signal is generated based on the estimate of the part of the audio signal that is within the time period.

14. The method according to claim 13, wherein the estimate is formed utilizing Linear Prediction Coding.

15. The method according to claim 13, wherein the hearing loss compensated output signal is also based on an estimate of a part of the audio signal before the time period, the estimate of the part of the audio signal before the time period being based on a part of the audio signal after the time period.

16. The method according to claim 13, wherein the hearing loss compensated output signal is also based on an estimate of a part of the audio signal after the time period, the estimate of the part of the audio signal after the time period being based on a part of the audio signal before the time period.

* * * * *